US011331903B2

(12) United States Patent
Plasswich et al.

(10) Patent No.: US 11,331,903 B2
(45) Date of Patent: May 17, 2022

(54) SLEEVE EXCHANGE SYSTEM

(71) Applicant: Windmoeller & Hoelscher KG, Lengerich (DE)

(72) Inventors: Franz Plasswich, Bremen (DE); Dietmar Poetter, Westerkappein (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 0 days.

(21) Appl. No.: 15/718,882

(22) Filed: Sep. 28, 2017

(65) Prior Publication Data

US 2018/0086047 A1 Mar. 29, 2018

Related U.S. Application Data

(63) Continuation of application No. 13/952,911, filed on Jul. 29, 2013, now Pat. No. 10,737,482, which is a continuation of application No. 13/064,365, filed on Mar. 21, 2011, now abandoned, which is a continuation of application No. 11/659,033, filed as application No. PCT/EP2005/008139 on Jul. 31, 2005, now abandoned.

(30) Foreign Application Priority Data

Jul. 31, 2004 (DE) ..... 10 2004 037 253.5

(51) Int. Cl.

| | |
|---|---|
| ***B41F 27/10*** | (2006.01) |
| ***B41F 13/193*** | (2006.01) |
| *B41F 27/14* | (2006.01) |
| *B41F 13/08* | (2006.01) |
| *B41F 13/44* | (2006.01) |

(52) U.S. Cl.

CPC ..... *B41F 27/105* (2013.01); *B41F 13/193* (2013.01); *B41F 13/08* (2013.01); *B41F 13/44* (2013.01); *B41F 27/14* (2013.01); *B41P 2227/21* (2013.01)

(58) Field of Classification Search

CPC .... B41P 2227/21; B41F 9/18; B41F 13/0016; B41F 13/44; B41F 27/105; B41F 27/14; B41F 30/00; B41F 30/04

See application file for complete search history.

(56) References Cited

U.S. PATENT DOCUMENTS

| | | | |
|---|---|---|---|
| 4,119,032 | A | 10/1978 | Hollis |
| 4,178,632 | A | 12/1979 | Anthony |

(Continued)

FOREIGN PATENT DOCUMENTS

| | | |
|---|---|---|
| DE | 19500729 | 7/1996 |
| DE | 19614514 | 10/1997 |

(Continued)

*Primary Examiner* — Jill E Culler

(74) *Attorney, Agent, or Firm* — Jacobson Holman PLLC

(57) ABSTRACT

A system for the replacement of sleeves that can be slipped on arbors of ink transfer rollers of at least printing machine has a storage device, in which the sleeves not being used in current ink transfer can be stored, and a transport device, with which several sleeves can be transported to the printing machine. The system has a transfer device the facilitates the transfer of the sleeves between the storage device and/or the transport device and the arbors of the ink transfer rollers, and/or between the storage device and the transport device.

15 Claims, 2 Drawing Sheets

(56) References Cited

U.S. PATENT DOCUMENTS

| | | | | |
|---|---|---|---|---|
| 4,461,663 | A * | 7/1984 | Tachibana | B41F 27/105 101/375 |
| 4,745,857 | A | 5/1988 | Putnam | |
| 4,748,911 | A | 6/1988 | Kobler | |
| 4,823,693 | A | 4/1989 | Kobler | |
| 5,142,978 | A | 9/1992 | Borel | |
| 5,188,027 | A | 2/1993 | Fantoni | |
| 5,282,418 | A | 2/1994 | Uera | |
| 5,588,361 | A | 12/1996 | Riis | |
| 5,778,779 | A * | 7/1998 | Jones | B41F 7/10 101/216 |
| 5,784,961 | A | 7/1998 | Lorig et al. | |
| 5,802,975 | A | 9/1998 | Prem et al. | |
| 5,878,666 | A * | 3/1999 | Schneider | B41F 13/20 101/217 |
| 6,386,103 | B1 * | 5/2002 | Charette | B41F 27/105 101/375 |
| 6,792,857 | B2 | 9/2004 | Sameit et al. | |
| 6,792,858 | B2 | 9/2004 | Kolbe et al. | |
| 6,918,338 | B2 | 7/2005 | Thiessen | |
| 7,748,317 | B2 * | 7/2010 | Puig Vila | B41F 27/1206 101/216 |
| 2003/0033949 | A1 * | 2/2003 | Salvestro | B41C 1/05 101/401.1 |
| 2005/0139109 | A1 | 6/2005 | Plasswich et al. | |
| 2006/0162600 | A1 | 7/2006 | Plasswich et al. | |
| 2011/0120330 | A1 * | 5/2011 | Rogge | B41F 5/24 101/329 |

FOREIGN PATENT DOCUMENTS

| | | |
|---|---|---|
| DE | 10022558 | 11/2001 |
| DE | 10223414 | 1/2004 |
| DE | 10305956 | 9/2004 |
| EP | 0277545 | 8/1988 |
| EP | 1195245 | 4/2002 |
| EP | 1362697 | 11/2003 |
| WO | WO 03/099565 | 12/2003 |

* cited by examiner

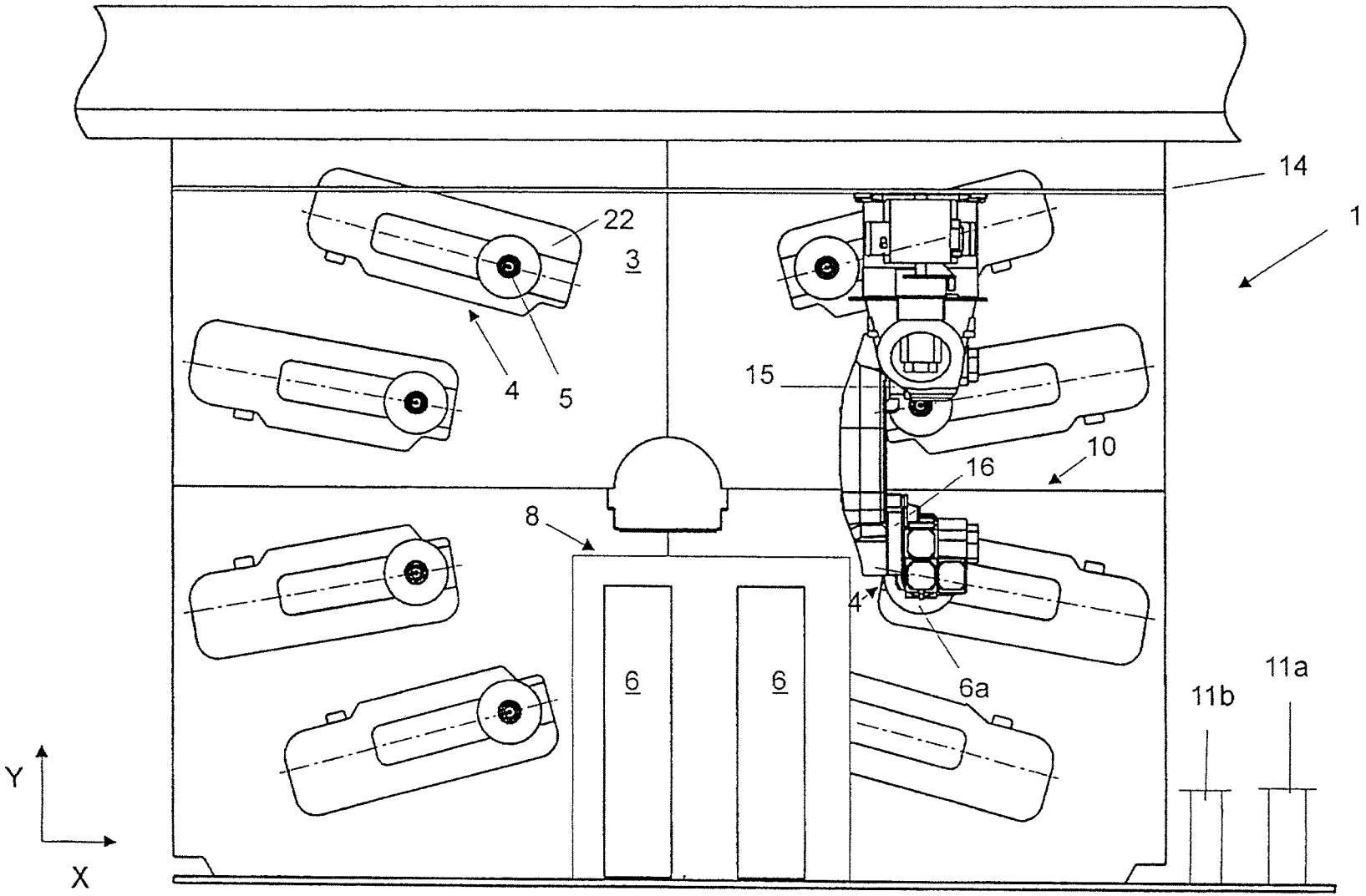
Fig 2 II - II

SLEEVE EXCHANGE SYSTEM

CROSS-REFERENCE TO RELATED APPLICATION

This is a divisional application of U.S. application Ser. No. 13/952,911 filed Jul. 29, 2013.

BACKGROUND OF THE INVENTION

Field of the Invention

The invention relates to a system for the replacement of sleeves of a printing machine.

Description of Related Art

In general, the ink transfer rollers are replaced for changing the printing form in the printing machines. The ink transfer rollers are thereby all the rollers of the printing machine, which are involved in the transport of ink between the ink reservoir and the substrate to be printed. In flexographic printing machines, these are the anilox rollers and the printing blocks or the printing rollers. For applications, in which there are frequent form replacements, the so-called sleeve technique in combination with ink transfer rollers with support at one end has proved to be successful. Thereby, in the form replacement, the complete ink transfer rollers are not replaced, but only the sleeves, which can be slipped on, and taken off from, the ink transfer rollers, which remain on the printing machines. The ink transfer rollers are therefore frequently supported at one end in the framework of the printing machine. In the printing operations, the free ends are often brought under control with bearing support absorbers, so that the oscillations of the ink transfer rollers can be prevented. Before replacing the sleeves, the support absorbers are removed from the arbors of the ink transfer roller, so that the sleeves can be taken off from the ink transfer rollers from free end of the ink transfer roller that are now free. Under the generic term sleeve come all possible types of sleeves, which can be used in ink transfer rollers. This includes not only the sleeves, which are suitable for the transport of the ink, but also the so-called adapter sleeves, which can be slipped on the arbor of an ink transfer roller, and on which another sleeve, which can be a sleeve for the ink transport or again an adapter sleeve, can be slipped on. Therefore, in printing machines, various different types of sleeves with different internal and external diameters find application.

Thus, in printing machines, particularly in such with several inking units, several sleeves per printing form must be brought together. In a printery, the entirety of the printing sleeves used in different printing forms must be managed, stored and in part moved to and from the arbors of the ink transfer rollers of the printing machines.

Several aids that simplify these tasks as far as possible are already known. Thus DE 102 23 414 shows a transport device with numerous support arbors for the printing sleeves. This transport device can be coupled with a lifting device. With the lifting device, the sleeves can be brought to the height of the printing unit to be equipped with these sleeves. Whereupon, the operator only needs, with practically linear movements, to take off the sleeves from the support arbors and slip them on the arbor of the ink transfer rollers. In analogous manner, the sleeves that are no longer needed can be removed from the inking units. After the uncoupling of the transport device, they can be transported to a storeroom or a storage device.

DE 100 22 558 C2 shows one such storage device in which a number of sleeves can be stored. After the operator removes the sleeves from the transport device, they are chucked in upend into the support elements. These support elements with the sleeves are fetched by a robot head and supplied to their respective destinations within the storage device.

EP 1 195 245 A1 discloses another storage device, in which the data about the printing sleeves are stored. In order to find out the printing sleeves easily, they are equipped with transponders, which can be read by data exchange devices.

A disadvantage thereby is that in many printeries, there are various types and devices, which serve the purpose of storage, transport and/or getting the sleeves on the arbors of the ink transfer rollers. But, whatever the case, the operator must take the sleeves at least once in the hands. In that situation, the operator must even feed the sleeve into the transport device and also remove from it, regardless of whether it involves a process of mounting or dismounting it in the printing machine. In a mounting or dismounting operation, it can happen that the operator arranges the sleeves in a false position in the printing machine, in the transport device or in the storage device. Further, due to the heavy weight of the sleeves in some cases, the operator is exposed to the risk of an accident during the replacement of the sleeves. Moreover, careless handling of the sleeves can even result in damage to the latter.

SUMMARY OF THE INVENTION

Therefore, the aim of the present invention is to provide a system of sleeves that can be slipped on the arbor of the ink transfer roller of a printing machine, while preventing the aforementioned disadvantages.

This problem is solved by a system for replacement of the sleeves with the features described herein.

According to that, the system for the replacement of the sleeves comprises devices for the transfer of the sleeves, with which the sleeves can be transported between the storage device and/or the means of the transport and the arbors of the ink transfer rollers in at least one printing machine and/or between the storage device and the means of transport.

By means of these devices for the transfer, the printing sleeves can be taken out directly from the storage device and, after bringing them up to the printing machine, they can be directly slipped on the arbor of the ink transfer rollers. However, it can also be provided with transport devices onto or into which the sleeves can be placed by the devices for the transfer after their removal from the storage device. Thereafter, these transport devices transport the sleeves to the printing machine, where they or other devices take off the sleeves for the transfer and slip them on, at least in part, on the arbor of the ink transfer device. The means for the transfer of the sleeves can slip on the sleeves, for instance, by two-third of the length of the sleeves on the arbor. Obviously, devices for the transport of the sleeves to convey them along the return path, that is, from the arbors of the ink transfer rollers to the means of transport, to the storage devices and/or between the devices for the transport and the storage, can also be employed. Thus, with this invention, a transport chain is created by means of which the sleeves can be transported without making it necessary for the operator to carry the sleeves, at least through a part of the path, manually, so that the disadvantages mentioned at the outset do not arise at all.

In order to enable the transport of the sleeves, the devices for the transfer of the sleeves are equipped with devices for receiving the sleeves. These devices for receiving the sleeves can have various different forms. Thus, they can be grippers, which hold the sleeves with clamps or grips, and can thereafter take them off from a storage device, wherein the sleeves are then stationed in vertical position, and slip them on the arbor of the ink transfer rollers. The devices for receiving the sleeves can be fixed on the robot arms in such a manner that the devices for receiving the sleeves have three degrees of freedom for translation and can rotate at least about two rotation axes. If the sleeves are transported by means of transport devices, the devices for the transfer from the sleeves can include a device, which moves the transport device in three dimensions relative to the printing machine. Thus, to slip the sleeves on, a linear movement of the sleeves along their axes is sufficient.

Thereby it is of particular advantage, if the devices for receiving the sleeves project, at least partially, into the interior of the sleeve. In this manner, the sleeves, which, as printing roller sleeves, have the printing motifs and, as anilox roller sleeves, have the cups for the transport of the ink, on their external surfaces, can be taken off with any risk of damage.

In another design according to the invention, a computing and control unit is provided. The latter steers the driving mechanism for driving the devices for the transfer of the sleeves in such a manner that the devices for receiving the sleeves can be brought from the arbors of the ink transfer roller in positions, wherefrom the transfer of the sleeves from the devices for receiving the sleeve on the arbor of the ink transfer roller into the storage device or the transport devices or the other way round can be done. Thus the transport can take place in an especially simple manner. In order to bring the sleeves only on the arbor for example, the sleeve need only to be displaced along their axis. The driving mechanism can thereby be, for instance, an electromotor, which acts upon the swivel joints or the travel units.

Thereby, it is especially advantageous, if the positions of the arbors of the ink transfer rollers, in which a replacement of a sleeve is to be made, and the respective target positions and the current positions of the sleeves in the printing machine, in the transport devices and/or in the storage device, are known to the computing and control unit. Thus, based on the parameters of the printing form, in particular from the previously defined allocation of the specific sleeves to specific arbors of the ink transfer sleeves, the computing and control unit can equip the printing machine automatically and free of error without any intervention by the operator.

In order to enable an exact positioning of the sleeves before the arbors of the ink transfer roller, these devices for the transport of the sleeves are provided with devices for rotating and tilting the sleeves. The arbors, with their one end free, meant for the purpose of the replacement of the sleeves, are subject to the force of gravitation, and are thus tilted, in dependence of the stiffness of the bearings supporting the arbor. However, since there is only very small play between the arbors and the sleeves, it is important that before the slipping on and taking off of the sleeves on or from the arbors, care is taken that the sleeves can be moved to or from the devices of the transport in such a manner that the sleeve axes are coaxial to the arbor axes. In another embodiment of this invention, this coaxiality can be continuously ascertained by sensors. For that, the sensors continuously determine the relative angular position of the axis of the sleeve on the device for receiving the sleeve with respect to the line of alignment with the axis of the ink transfer roller.

In another especially advantageous embodiment of the invention, the relative angular positions determined by the sensors are communicated to the computing and control unit, which transmits signals to the actuators of the transport devices of the sleeves until the devices for receiving the sleeves are so positioned that the axis of the arbor of the ink transfer roller is aligned with the axis of a sleeve, if the sleeve was received by the device for receiving the sleeve. With this measure, tilting over of the sleeve and the arbor during the processes of the slipping on or taking off is prevented. The positioning takes place on the basis of the described approach regardless of how far apart the arbor lowers due to the release of one end. This is particularly important, because the bearing supports of the printing rollers are subject to wear and tear, but the worn parts of the support are also replaced and therefore the path of the lowering of the released end of the arbor varies. If such exact positioning takes place, the device for transport or the device for receiving the sleeve, for instance, can be detatchably coupled to the arbor, in order to prevent the dejustification. If, despite that, a dejustification follows a tilting over of the sleeves and the arbor, which can be measured by means of a monitoring device, such as a dynamometer, the process of slipping on or taking off can be interrupted, so that a major damage to the device for the transfer, the sleeves and/or the printing machine can be prevented.

In another embodiment of the invention, the devices for the transfer and/or at least one printing machine are provided with pushing devices, with which the sleeves can be displaced along their axes. Thereby the pushing devices can act on the outer surfaces of the sleeves, so that they can pull and push them. Thereby, depending on the range of the pushing devices, it is sufficient to provide these pushing devices only on the printing machine or only on the device for transfer. However, it is particularly advantageous to provide the shifting devices on the devices for transfer and on the printing machine, which pushing devices can then exercise pressure only on the front side of the sleeves to push them. It is thus prevented that the outer surfaces of the sleeves are affected.

As mentioned at the outset, sleeves with different internal and external diameters are used in printing machines. For this reason it of advantage if the devices for receiving the sleeves can be adapted to these different diameters. This is possible in a particularly simple manner if the devices for receiving the sleeves are so designed that they can be coupled or uncoupled. Depending on the diameter of the sleeve to be transported, a matching device for receiving the sleeves can be coupled to the device for transfer.

It is advantageous thereby, if the device for receiving the sleeve has an arbor-shaped embodiment and its outer diameter is variable. The devices for receiving the sleeve can thus be introduced into the interior, after which they are frictionally engaged. With that, the sleeve is secured against displacement relative to the device for receiving the sleeve. If that is the case, the device for the transfer of the sleeves can be slipped on directly on the arbor of the ink transfer rollers, so that at least some of the pushing devices can be dispensed with.

The features of the invention offer a solution for the abovementioned problem, in which a method for the replacement of the sleeves is provided, in which the computing and control unit work out an arrangement of the sleeves in the transport device, in which one position remains free for receiving at least one more sleeve. In this matter, the maximum number of sleeves can be transported in the devices for the transport.

In another advantageous embodiment of the method, during the installation of the printing machine, at first one sleeve of the printing machine is taken off and introduced into the free position of the device for the transport. Thereafter a new sleeve is taken from the device for the transport and delivered to the arbor that just became free. This process is repeated until all the sleeves of the printing machine to be replaced are delivered as well as removed from the printing machine. Thus, the devices for transfer are spared the unnecessary traversal of the paths, which would be the case, for instance, if all the sleeves are removed at first and then new sleeves are delivered to the printed machine.

Other exemplary embodiments of the invention follow from the objective description and the claims.

BRIEF DESCRIPTION OF THE DRAWINGS

The individual figures show:

FIG. 2 View II-II according to FIG. 1

DETAILED DESCRIPTION OF THE PREFERRED EMBODIMENTS

Figure 1:
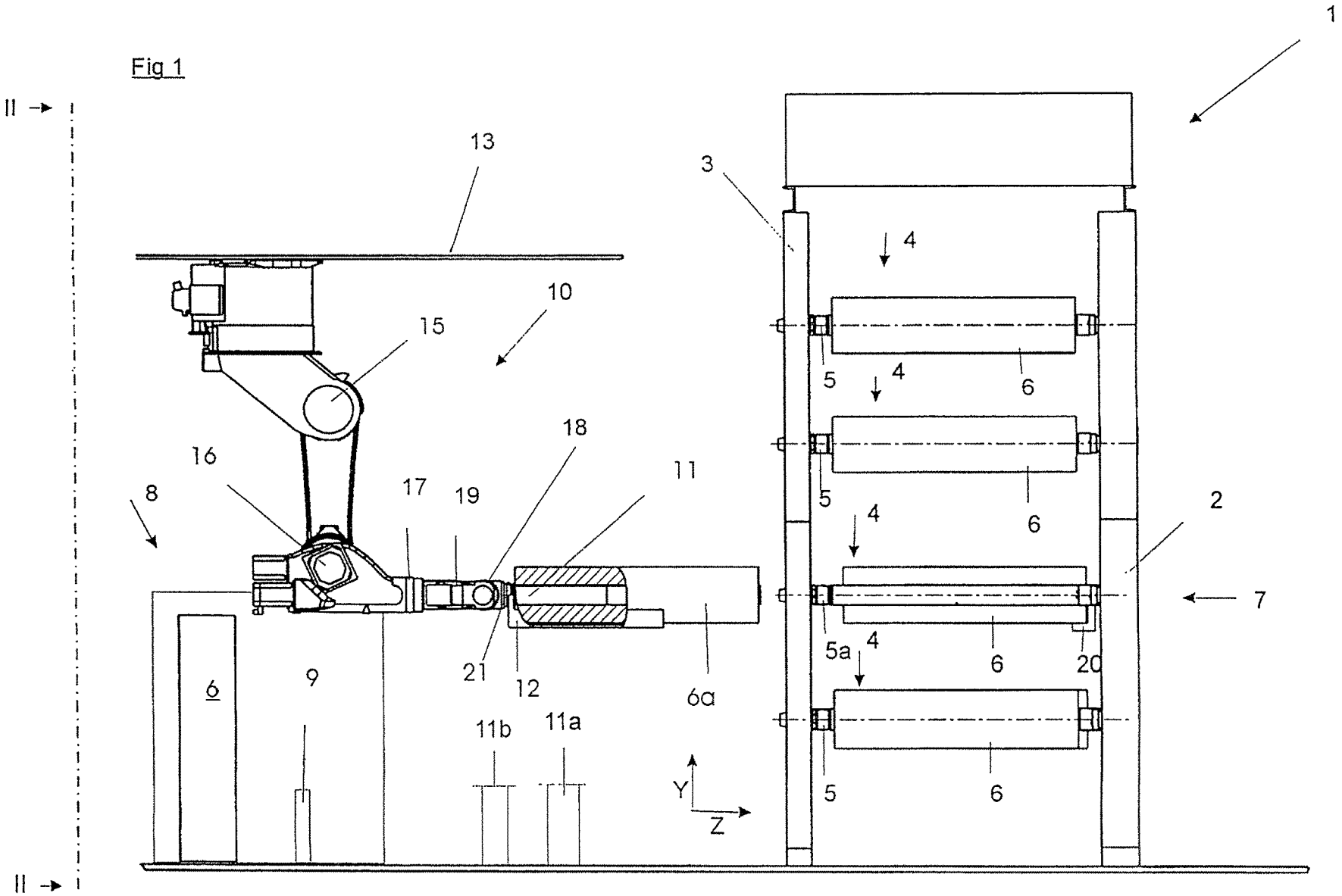
FIG. 1 A system for replacement of sleeves

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed, description.

FIG. 1 shows a printing machine 1, which comprises the side frames 2 and 3. The ink transfer rollers 4 are supported, turned inwards, on pillow blocks not shown here. The pillow blocks are on guide rails, also not shown, which are mounted on side frame 2 displaceably relative to the side frames. Thus the ink transfer rollers 4 can be adjusted against the counterpressure cylinder, also not shown here, or against each other, so as to ensure the transfer of the ink on the substrate for printing, which is guided by means of the counterpressure cylinder. In the side frame 3, pillow blocks are also mounted displaceably on rails. These pillow blocks are provided with supports, which are movable relative to the pillow blocks, so that the arbor 5 of the ink transfer roller 4 can be optionally supported or released. The sleeves 6, which can be slipped on in the direction z of the arbor 5, can impinge on the ink transfer rollers 4.

To replace the sleeves 6, the pillow blocks in the side frame 3 are first removed from the corresponding ink transfer rollers 4. Then the sleeve can be taken off from the arbor 5 opposite to the direction z and thereafter a new sleeve 6 can be slipped on the arbor. The printing unit 7 illustrates the situation in which the sleeve 6*a* is taken off from the arbor 5*a*.

For the delivery or the transport of the sleeves 6, a transport device 8 is provided, which can be moved relative to the printing machine 1. This transport device 8 can be embodied as a palette. In the example shown, the transport device 8 contains a new sleeve 6, which is to be delivered to the arbor 5*a* of the printing unit 7 that just became free. However, in order to accommodate the sleeve 6*a* just taken out in the direction of transport 8, it has a free position, which is embodied as a vertically projecting retainer arbor 9.

For the transfer of the sleeves 6 and 6*a* between the printing machine 1 and the transport device 8, a transfer device 10 is provided. To convey the sleeve 6, 6*a*, a support element 11 is provided, which is embodied with an arbor-like shape and projects, for instance, into one third of the interior of the sleeve 6*a*.

The transfer device 10 is, as one can see in FIGS. 1 and 2, suspended on the rails 13, 14. This suspension enables displacement of the transfer device 10 along a horizontal plane spanned by the direction arrows x and z. For that, driving motors, not shown here, are provided. The transport device exhibits, in addition, two swivel joints 15 and 16, whose axes of rotation extend parallel to the direction arrow x. The swivel joints 15, 16 enable adjustment of the heights of the sleeves 6, 6*a* in direction y. However, the sleeves 6, 6*a* can also be tilted so that these 6, 6*a* can be brought from a vertical position into a horizontal position. The swivel joints are driven by driving motors such as, for example, electromotors.

Due to the aforementioned possibilities of the movement of the transfer device 10, it is now possible to bring a sleeve 6, 6*a* before an arbor 5, 5*a* in such a manner that the principal axis of inertia of the sleeve 6, 6*a* is aligned with the axis of that arbor 5, 5*a*. Due to the play of the swivel joints 15, 16, as well as also due to the small pitching movement of the arbor 5 during the release of the ends in the area of the side frame 3, it can happen in practice that the named axes are not aligned, but extend away from each other in direction z. In order to counteract against this effect, the transfer device 10 comprises a swivel joint for justification 18, whose axis of rotation also extends in the direction x. By means of sensors not shown, it can be determined whether the axes are aligned or not. If the justification of the axes is complete and the axes extend coaxially, the transfer device 10 as a whole can be displaced in direction z, until the support element 11 touches the arbor 5, 5*a*. When that is the case, major part of the sleeve 6, 6*a* is already slipped on the arbor 5, 5*a*. In order to slip on the sleeves 6, 6*a* completely on the arbor, the slider 12 is displaceable relative to the transfer device 10 in the direction z. The slider 12 acts thereby on the front side of the sleeve 6, 6*a* facing the lower support arm 17.

Frequently the arbors 5, 5*a* of ink transfer rollers have 4 small pins. The sleeves 6, 6*a* then have complementary grooves, so that when the sleeves are fully slipped on the arbor, the groove surrounds the pin. After the slipping on of the sleeve 6, 6*a*, it is thus automatically adjusted with respect to its longitudinal axis, as well also in the circumferential direction relative to the arbor. In order that the groove can surround the pin, the transfer device comprises another swivel joint 19, whose axis of rotation extends concentrically to the axis of the sleeve, so that a rotation of the sleeve 6, 6*a* relative to the arbor 5, 5*a* before or during the process of slipping on is possible, so that the pin and the groove can be brought in mutual engagement.

If a sleeve 6, 6*a* is taken off from an arbor 5, 5*a*, the axes of the corresponding arbor 5, 5*a* and the support element 11 are adjusted in alignment, so that the axis of the sleeve is also aligned with the axis of the arbor, if the sleeve is slipped on the support element 11, even when it suntil stands in partial contact with the arbor. After the alignment of the orientations, a pushing device 20 pushes the sleeve away from the arbor 5, 5*a*. Such a pushing device 20 can be provided on each arbor, however, it is shown only for the printing unit 7 for the sake of simplicity. After the process of pushing, the sleeve 6, 6*a* surrounds the support element 11 completely. It is of advantage if the external diameter of the support element 11 is variable, so that frictional engagement between the support element 11 and the sleeve 6, 6*a* can be established. After that, the sleeve 6, 6*a* can be taken off completely from the arbor 5, 5*a* by the transfer device.

In printing machine 1, the sleeves 6, 6*a* with different internal diameters can be used. It is especially then the case, if an adapter sleeve is slipped on the arbor 5, 5*a* at first and thereafter a sleeve 6, 6*a* is slipped on the adapter sleeve. In order that all the sleeves 6, 6*a* can remain in frictional engagement with the support element from within, the support elements 11, 11*a*, 11*b* are provided with different external diameters. For each of the internal diameter of the sleeve 6, 6*a* that can be used in printing machine 1, a support element can be provided. Due to the degrees of freedom of the transfer device 10, it can automatically replace the support elements 11, 11*a*, 11*b*. For that, the transfer device 10 is provided with a coupling 21, which establishes or interrupts compressed air and/or current connection between the transfer device 10 and the support element.

FIG. 2 shows the view II-II according to FIG. 1. The side frame 3 has the recesses 22 in the area of the individual inking units, through which the ink transfer rollers 4 can be reached in such a manner that the sleeves 6, 6*a* can be taken off from the arbors 5, 5*a* through the recesses 22. For the sake of simplicity, of each inking unit, only one ink transfer roller 4 is shown. In general, for instance in flexographic printing machines, there are two ink transfer rollers 4 per inking unit, namely an anilox roller and a printing roller. In particular, both the swivel joints 15, 16 of the transfer device 10 are shown. The rails 14 serve the purpose of moving the transfer device 10 parallel to the frontage of the side frame 3. In order that maximum possible room for movement is available for the transfer device 10, the side frame 3 is devoid of front structures or elevations.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Symbols | |
|---|---|
| 1 | Printing machine |
| 2 | Side frame |
| 3 | Side frame |
| 4 | Ink transfer roller |
| 5, 5a | Arbor |
| 6, 6a | Sleeves |
| 7 | Printing unit |
| 8 | Transport device |
| 9 | Retainer arbor |
| 10 | Transfer device |
| 11, 11a, b | Support element |
| 12 | Slider |
| 13 | Rails |
| 14 | Rails |
| 15 | Swivel joint |
| 16 | Swivel joint |
| 17 | Lower support arm |
| 18 | Swivel joint for justification |
| 19 | Swivel joint |
| 20 | Pushing device |
| 21 | Coupling |
| 22 | Recess |
| 23 | |
| 24 | |

What is claimed is:

1. A system for exchanging sleeves associated with arbors of ink transfer rollers of a printing machine, as the system transitions from a printing job to a subsequent printing job, said systems comprising:

a storage device, in which the sleeves, if not used in a current ink transfer, are stored;

a transport device, with which a plurality of the sleeves are individually transported from the storage device to the printing machine;

a device for exchanging the sleeves to and from the arbors, the device for exchanging the sleeves including a support element for receiving the sleeve, and a movable slider for displacing the sleeve longitudinally along a sleeve axis relative to the support element, with the slider being adapted to contact the sleeve from an interior or an exterior thereof; and a computing and control unit configured (i) to know, based parameters of a printing form associated with the printing job and parameters of a printing form associated with the subsequent printing job, a position of each of the arbors of each of the ink transfer rollers, in which a replacement of the sleeve is to be effected, and a respective target position and current position of each of the sleeves in the printing machine, in the transport device, and in the storage device, and (ii) to automatically equip the printing machine, based on said parameters of the printing form associated with the printing job and parameters of the printing form associated with the subsequent printing job, and based on said known positions of the arbors, rollers and sleeves, with the sleeves associated with a respective one of the printing forms so as to effect the transition from the printing job to the subsequent printing job.

2. The system according to claim 1, wherein the support element for receiving the sleeve projects at least in part into an interior of the sleeve.

3. The system according to claim 1, wherein the computing and control unit controls a driving device for driving the device for the exchange of the sleeve in such a manner that the support element for receiving the sleeve is placed in positions in which the exchange of the sleeve from the support element for receiving the sleeve onto the arbor of the ink transfer roller, into the storage device, or the inverse, is carried out.

4. The system according to claim 1, wherein the device for exchanging the sleeve is configured to at least rotate and tilt the sleeves.

5. The system according to claim 1, further comprising a sensor, with which a relative angular position of the sleeve to the support element for receiving the sleeve with respect to a line of alignment with an axis of the ink transfer roller are determined.

6. The system according to claim 5, wherein based on the relative angular position of the sleeve on the support element for receiving the sleeve with respect to the line of alignment with the axis of the arbor of the ink transfer roller, as determined by the sensor, as well as the target position, the computing and control unit transmits a signal to the device for exchange of the sleeve, until the support element for receiving the sleeve is so positioned that the axis of the arbor of the ink transfer roller is aligned with the axis of the sleeve.

7. The system according to claim 1, wherein the printing machine includes a pushing device, with which the sleeve is pushed along the axis thereof.

8. The system according to claim 1, wherein the support element for receiving the sleeve is adapted to be coupled and uncoupled with the device for exchange of the sleeve.

9. The system according to claim 1, wherein the device for the transport includes a traversable carriage, which assumes a defined position relative to the printing machine for the replacement of the sleeve, with the position of the traversable carriage being known to the computing and control unit.

10. A method for replacement of a printing sleeve with a system according to claim 1, wherein the computing and control unit determines an arrangement of the sleeve, which is to be replaced, in the transport device, with one position for receiving at least one more sleeve remaining free in the transport device.

11. The method according to claim 10, wherein the device for the exchange removes the sleeve from the arbor of the ink transfer roller, and delivers the sleeve to the free position, and the device for the exchange takes a different sleeve from the transport device, and delivers the different sleeve to the arbor from which the sleeve had been removed.

12. The method according to claim 11, wherein the free position in the transport device, to which the sleeve, removed from the arbor of the ink transfer roller, is delivered, and the position, from which a next sleeve is taken, are directly adjacent.

13. The system according to claim 1, wherein the support element has an external diameter that is variable so as to provide for secured frictional engagement with a corresponding internal diameter of the sleeve during positioning of the sleeve on the arbor, and subsequent disengagement therefrom once the sleeve is positioned on the arbor.

14. The system according to claim 1, further comprising a robotic arm having three degrees of freedom for translation, the robotic arm being rotatable about at least two axes of rotation, and having a first joint that provides for coaxial alignment of an axis of the sleeve with an axis of the arbor, and a second joint that provides for circumferential alignment of the sleeve with the arbor before or during the receipt of the sleeve by the support element.

15. The system according to claim 14, wherein the coaxial alignment of the axis of the sleeve with the axis of the arbor is with respect to a substantially vertical direction.

* * * * *